US010976693B2

(12) United States Patent
Hashimoto

(10) Patent No.: US 10,976,693 B2
(45) Date of Patent: Apr. 13, 2021

(54) IMAGE FORMING APPARATUS INCLUDING TECHNIQUE OF DETECTING FULL STATE OF A WASTE-TONER BOX

(71) Applicant: BROTHER KOGYO KABUSHIKI KAISHA, Nagoya (JP)

(72) Inventor: Yohei Hashimoto, Nagakute (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 16/884,390

(22) Filed: May 27, 2020

(65) Prior Publication Data

US 2020/0387107 A1 Dec. 10, 2020

(30) Foreign Application Priority Data

Jun. 6, 2019 (JP) ..... JP2019-106460

(51) Int. Cl.
*G03G 21/10* (2006.01)
*G03G 21/12* (2006.01)
*G03G 15/00* (2006.01)

(52) U.S. Cl.
CPC ..... *G03G 21/12* (2013.01); *G03G 15/55* (2013.01); *G03G 21/105* (2013.01)

(58) Field of Classification Search
CPC ..... G03G 21/12; G03G 15/55; G03G 15/556
USPC ..... 399/35
See application file for complete search history.

(56) References Cited

U.S. PATENT DOCUMENTS

| | | | | |
|---|---|---|---|---|
| 9,958,824 | B2 * | 5/2018 | Takeuchi | G03G 15/556 |
| 2009/0116853 | A1 | 5/2009 | Okazaki et al. | |
| 2013/0223859 | A1 | 8/2013 | Wakamatsu et al. | |

FOREIGN PATENT DOCUMENTS

| | | | |
|---|---|---|---|
| JP | 5-134587 | A | 5/1993 |
| JP | 2001-075439 | A | 3/2001 |
| JP | 4492676 | B2 | 4/2010 |
| JP | 2013-182079 | A | 9/2013 |
| JP | 5538318 | B2 | 7/2014 |

* cited by examiner

*Primary Examiner* — William J Royer
(74) *Attorney, Agent, or Firm* — Merchant & Gould P.C.

(57) ABSTRACT

A first waste-toner box includes a detection switch wherein a state of the detection switch changes depending on an amount of waste toner stored therein. A second waste-toner box without the detection switch is initially mounted on a housing. The first waste-toner box is mounted after replacement of the second waste-toner box. A sensor circuit detects the state of the detection switch. In a case where the second waste-toner box is mounted on the housing, a controller detects a full state of waste toner stored in the second waste-toner box based on a dot count that is a number of dots forming a toner image formed on a sheet; and in a case where the first waste-toner box is mounted on the housing, the controller detects a full state of waste toner stored in the first waste-toner box based on the state of the detection switch.

14 Claims, 11 Drawing Sheets

IMAGE FORMING APPARATUS INCLUDING TECHNIQUE OF DETECTING FULL STATE OF A WASTE-TONER BOX

CROSS REFERENCE TO RELATED APPLICATIONS

This application claims priority from Japanese Patent Application No. 2019-106460 filed Jun. 6, 2019. The entire content of the priority application is incorporated herein by reference.

TECHNICAL FIELD

This disclosure relates to an image forming apparatus.

BACKGROUND

In a conventional electrophotographic image forming apparatus that forms an image by transferring a toner image supported on a photosensitive drum to a recording medium, waste toner remaining on the photosensitive drum is collected and stored in a waste-toner box. The waste-toner box is detachably mounted on a housing of the image forming apparatus. The waste-toner box is configured to be replaced when the waste-toner box becomes full of the waste toner stored therein.

As an exemplary known technique of detecting the full state of a waste-toner box, the amount of generated waste toner is estimated based on a print ratio which is the ratio of an image formed on a recording medium per unit area of the recording medium in order to detect the full state of the waste-toner box. According to another known technique, a waste-toner box is provided with a detector for detecting the full state of the waste-toner box by waste toner. A controller of an image forming apparatus reads an output from the detector, thereby detecting the full state of the waste-toner box.

SUMMARY

According to one aspect, this specification discloses an image forming apparatus. The image forming apparatus includes a photosensitive drum, a belt, a housing, a sensor circuit, and a controller. The belt is disposed to face the photosensitive drum. The housing is configured such that one of a first waste-toner box and a second waste-toner box is selectively mounted thereon. The first waste-toner box includes a detection switch wherein a state of the detection switch changes depending on an amount of waste toner stored therein. The second waste-toner box does not include the detection switch. The second waste-toner box is initially mounted on the housing. The first waste-toner box is mounted on the housing after replacement of the second waste-toner box. The sensor circuit is configured to detect the state of the detection switch. The controller is configured to: in a case where the second waste-toner box is mounted on the housing, perform a first full-state detection mode of detecting a full state of waste toner stored in the second waste-toner box based on a dot count that is a number of dots forming a toner image formed on a sheet; and in a case where the first waste-toner box is mounted on the housing, perform a second full-state detection mode of detecting a full state of waste toner stored in the first waste-toner box based on the state of the detection switch detected by the sensor circuit.

According to another aspect, this specification also discloses an image forming apparatus. The image forming apparatus includes a photosensitive drum, a belt, a housing, reading means, and control means. The belt is disposed to face the photosensitive drum. The housing is configured such that one of a first waste-toner box and a second waste-toner box is selectively mounted thereon. The first waste-toner box includes detection means wherein a state of the detection means changes depending on an amount of waste toner stored therein. The second waste-toner box does not include the detection means. The second waste-toner box is initially mounted on the housing. The first waste-toner box is mounted on the housing after replacement of the second waste-toner box. The reading means is for reading the state of the detection means. The control means is for: in a case where the second waste-toner box is mounted on the housing, performing a first full-state detection mode of detecting a full state of waste toner stored in the second waste-toner box based on a dot count that is a number of dots forming a toner image formed on a sheet; and in a case where the first waste-toner box is mounted on the housing, performing a second full-state detection mode of detecting a full state of waste toner stored in the first waste-toner box based on the state of the detection means read by the reading means.

BRIEF DESCRIPTION OF THE DRAWINGS

Embodiments in accordance with this disclosure will be described in detail with reference to the following figures wherein.

DETAILED DESCRIPTION

In the foregoing configuration of detecting the full state of the waste-toner box based on a print ratio, as the estimated value of the amount of generated waste toner has a large error, it is necessary to determine to be a full state well before the waste-toner box actually becomes full. This causes difficulty in making full use of the capacity of the waste-toner box. In particular, for a user who forms many images generating large amounts of waste toner on a recording medium, it is necessary for the user to replace the waste-toner box frequently, which causes large time, effort and costs for replacement of the waste-toner box.

In the configuration with the detector provided at the waste-toner box for detecting full state of waste toner, the provision of the detector increases the cost of the waste-toner box. In particular, for a user who mainly forms images generating small amounts of waste toner on a recording medium, the image forming apparatus often comes to the end of its product life before the waste-toner box becomes full, and thus the provision of the costly waste-toner box may be wasteful.

In view of the foregoing, an aspect of an object of this disclosure is to provide an image forming apparatus configured to suppress time and costs for a user who forms images that generate large amounts of waste toner and to suppress costs for a user who forms images that generate small amounts of waste toner.

An aspect of this disclosure will be described while referring to the accompanying drawings.

[Entire Configuration of Image Forming Apparatus]

Figure 1:
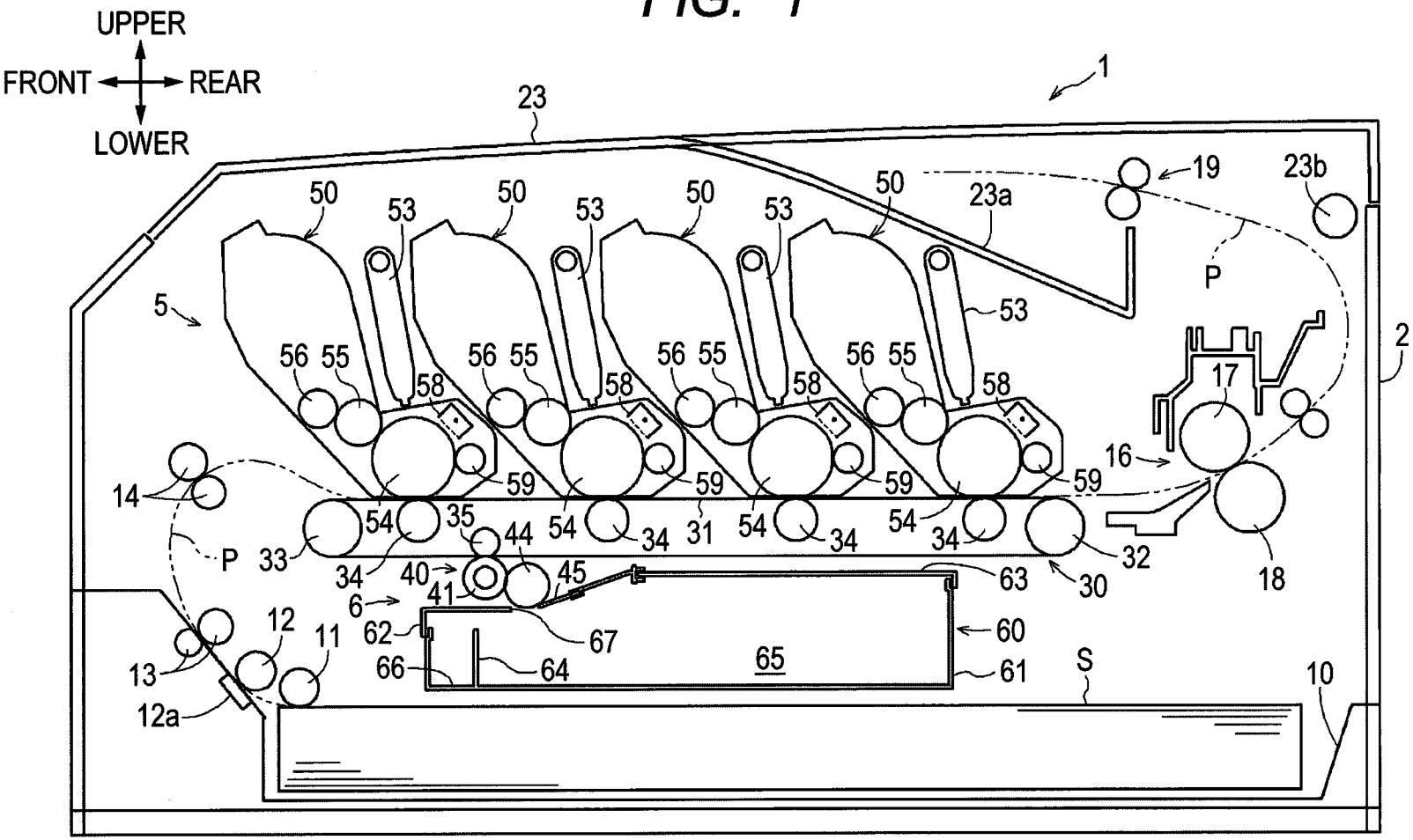
FIG. 1 is a vertical cross-sectional view showing a center part of an image forming apparatus.

An image forming apparatus 1 shown in FIG. 1 is one embodiment of an image forming apparatus of this disclosure and is an electrophotographic tandem color printer for forming an image of a plurality of colors on a sheet S as an example of a recording medium.

In the following description, the left side of FIG. 1 is defined as the front side of the image forming apparatus 1, the right side of FIG. 1 is defined as the rear side of the image forming apparatus, the near side in the direction perpendicular to the drawing sheet of FIG. 1 is defined as the right side of the image forming apparatus 1, and the far side in the direction perpendicular to the drawing sheet of FIG. 1 is defined as the left side of the image forming apparatus 1. Further, the upper side and the lower side of FIG. 1 are defined as the upper side and the lower side of the image forming apparatus 1 respectively.

The image forming apparatus 1 includes a housing 2, a paper feed tray 10 configured to support sheets S, and an image forming unit 5 configured to form images on the sheets S.

The housing 2 is formed into a substantially rectangular parallelepiped and accommodates the paper feed tray 10 and the image forming unit 5. The housing 2 has an upper end portion where a top cover 23 is provided to be swingable about a pivotal support 23*b* at a rear end portion of the housing 2. The top cover 23 is provided with a paper discharge tray 23*a* slanted downward from the front side toward the rear side.

A conveyance path P for the sheets S extending from the paper feed tray 10 to the paper discharge tray 23*a* through the image forming unit 5 is formed in the housing 2. A paper feed roller 11, a separation roller 12, a separation pad 12*a*, a conveyance roller pair 13, and a registration roller pair 14 are provided in the housing 2.

The sheets S supported on the paper feed tray 10 are separated by the paper feed roller 11, the separation roller 12, and the separation pad 12*a*, and are fed one sheet at a time to the conveyance path P.

After the sheet S is fed to the conveyance path P, the sheet S is conveyed by the conveyance roller pair 13 and the registration roller pair 14 toward the image forming unit 5. The registration roller pair 14 restricts the movement of the leading end of the sheet S being conveyed and stops the sheet S once, and then conveys the sheet S toward the image forming unit 5 at a predetermined timing.

The image forming unit 5 is arranged above the paper feed tray 10 and includes four process units 50 arranged side by side in the front-rear direction. The process units 50 are each detachably mounted on the housing 2 and provided for each of the corresponding colors including black, yellow, magenta, and cyan.

Each process units 50 includes a photosensitive drum 54 and a developing roller 55. The photosensitive drum 54 is formed into a substantially cylindrical shape extending in the left-right direction which is the axis direction, and is rotatably supported by the process unit 50. The developing roller 55 extends in the left-right direction and is rotatably supported by the process unit 50. The developing roller 55 contacts an upper front portion of the photosensitive drum 54.

Each LED unit 53 is arranged above the corresponding photosensitive drum 54 to face the photosensitive drum 54. The LED unit 53 exposes the surface of the photosensitive drum 54 to light. The LED unit 53 is supported on the top cover 23.

Each process unit 50 includes a supply roller 56, a scorotron charger 58, and a drum cleaning roller 59. The supply roller 56 supplies the developing roller 55 with toner as a developer. The developing roller 55 supplies the toner to the photosensitive drum 54. The toner is stored above the developing roller 55 and the supply roller 56 in the process unit 50.

Each scorotron charger 58 is arranged at an upper rear side of the corresponding photosensitive drum 54 to face the photosensitive drum 54. The drum cleaning roller 59 is arranged below the scorotron charger 58 to face the photosensitive drum 54.

A belt 31 is arranged below the photosensitive drum 54 across the conveyance path P to face the photosensitive drum 54. The belt 31 is stretched between a driving roller 32 and a driven roller 33 at the front of the driving roller 32.

Each transfer roller 34 is arranged at a position facing the corresponding photosensitive drum 54 across the belt 31. The belt 31, the driving roller 32, the driven roller 33, the transfer roller 34, and so on form a belt unit 30.

In the image forming unit 5, the surface of the photosensitive drum 54 is charged uniformly by the scorotron charger 58, and then exposed selectively to light by the LED unit 53 based on particular image data. In this way, an electrostatic latent image based on the image data is formed on the surface of the photosensitive drum 54.

The toner stored in the process unit 50 is positively charged between the supply roller 56 and the developing roller 55, and then borne on the surface of the developing roller 55. The toner borne on the developing roller 55 is supplied to the electrostatic latent image on the surface of the photosensitive drum 54. In this way, a toner image is borne on the surface of the photosensitive drum 54.

When the sheet S conveyed toward the image forming unit 5 reaches a position on the belt 31, the sheet S is conveyed by the belt 31 and passes sequentially between the belt 31 and each of the photosensitive drums 54.

When the toner image on the surface of the photosensitive drum 54 comes to a position facing the sheet S, the toner image is transferred onto the sheet S by a transferring bias applied to the transfer roller 34. In this way, the toner image borne on the photosensitive drum 54 is transferred to the sheet S by the belt unit 30.

At this time, the toner may remain on the surface of the photosensitive drum 54 without being transferred to the sheet S. As the photosensitive drum 54 rotates, the waste toner remaining on the surface of the photosensitive drum 54 comes to a position facing the drum cleaning roller 59. The waste toner facing the drum cleaning roller 59 is retained electrically on the surface of the drum cleaning roller 59 by a drum cleaning bias.

The belt 31 of the embodiment is configured as a conveyance belt for conveying the sheet S on which a toner image is to be transferred. Alternatively, the belt 31 may be configured as an intermediate transfer belt on which a toner image is transferred to the belt itself and is then further transferred onto the sheet S.

The sheet S with the transferred toner image is conveyed to a fixing device 16 arranged downstream of the image forming unit 5. The fixing device 16 includes a heating roller 17 and a pressure roller 18 in pressure contact with the heating roller 17. After the sheet S is conveyed to the fixing device 16, the toner image is thermally fixed while the sheet S passes between the heating roller 17 and the pressure roller 18.

The sheet S with the thermally fixed toner image is conveyed downstream of a conveyance direction from the fixing device 16, conveyed further by paper discharge rollers 19, and discharged onto the paper discharge tray 23*a* of the top cover 23.

A belt cleaner unit 6 is provided below the belt 31 and above the paper feed tray 10 in the housing 2. The belt cleaner unit 6 is used for collecting and storing waste toner adhering to the belt 31. The belt cleaner unit 6 includes a belt cleaner 40 that collects the waste toner adhering to the belt 31 from the belt 31, and a waste-toner box 60 that stores the waste toner collected from the belt 31 by the belt cleaner 40.

The belt cleaner 40 includes a belt cleaning roller 41, a collection roller 44, and a scraper blade 45. The belt cleaning roller 41 is arranged at a position below the belt 31 and facing a backup roller 35 arranged inside the belt 31.

The belt cleaning roller 41 extends in the left-right direction and is formed by covering a roller shaft with a substantially cylindrical conductive resin member. The backup roller 35, which is inside the belt 31, is arranged to contact the belt 31 from above. The backup roller 35 is formed of a substantially circular columnar metallic member extending in the left-right direction.

The collection roller 44 contacts the belt cleaning roller 41 from the rear of the belt cleaning roller 41. The collection roller 44 is formed of a substantially circular columnar metallic member extending in the left-right direction. The scraper blade 45 is arranged at a rear-lower side of the collection roller 44. The scraper blade 45 is formed of a flat-plate member elongated in the left-right direction. The scraper blade 45 has a front end portion in contact with a lower portion of the surface of the collection roller 44.

The waste-toner box 60 is arranged below the belt cleaner 40. The waste-toner box 60 includes a housing frame 61, a support frame 62, and a cover frame 63.

The housing frame 61 is formed into a box shape substantially rectangular in a plan view with an open upper surface and a closed bottom. A partition wall 64 having a substantially flat-plate shape extending in the left-right direction is provided in a middle of the interior of the housing frame 61 in the front-rear direction. The housing frame 61 is divided by the partition wall 64 into a first housing portion 65 at the rear and a second housing portion 66 at the front.

The support frame 62 covers the front of the upper surface of the housing frame 61. A collection opening 67 penetrating through the support frame 62 in the upper-lower direction is formed in a middle of the support frame 62 viewed in the front-rear direction. The collection opening 67 extends in the left-right direction and is arranged under the collection roller 44. The cover frame 63 is arranged at the rear of the support frame 62 and covers the rear of the upper surface of the housing frame 61.

The belt cleaning roller 41 and the collection roller 44 of the belt cleaner 40 are rotatably supported on the support frame 62. The scraper blade 45 has a rear end portion supported on the support frame 62, and has a front end portion facing the collection opening 67.

In the embodiment, the belt cleaner 40 and the waste-toner box 60 are formed integrally. The belt cleaner 40 and the waste-toner box 60 are detachably mounted integrally as the belt cleaner unit 6 on the housing 2.

[Cleaning Operation of Waste Toner]

In the image forming apparatus 1, when the image forming unit 5 finishes image formation, a cleaning operation is started. In the cleaning operation, waste toner retained on the drum cleaning roller 59 is collected by using the belt cleaner 40 and the collected waste toner is collected in the waste-toner box 60.

In the cleaning operation, waste toner retained on the drum cleaning roller 59 is first discharged onto the surface of the photosensitive drum 54 and the photosensitive drum 54 is rotated. As the photosensitive drum 54 is rotated, the waste toner discharged to the surface of the photosensitive drum 54 comes to a position facing the belt 31.

The waste toner on the surface of the photosensitive drum 54 facing the belt 31 is transferred to the surface of the belt 31 by a transferring bias of the transfer roller 34. After the waste toner is transferred to the surface of the belt 31, the waste toner comes to a position facing the belt cleaning roller 41 due to the circulation of the belt 31.

The waste toner facing the belt cleaning roller 41 is electrostatically retained on the surface of the belt cleaning roller 41 by a belt cleaning bias applied to the belt cleaning roller 41, and then transferred electrostatically to the collection roller 44.

The waste toner transferred to the collection roller 44 is scraped off with the scraper blade 45, and then drops into the first housing portion 65 through the collection opening 67 of the waste-toner box 60. After dropping into the first housing portion 65, the waste toner is conveyed rearward by conveying means (not shown).

[First Waste-Toner Box and Second Waste-Toner Box]

The waste-toner box 60 is configured as a first waste-toner box 60A and a second waste-toner box 60B. Either one of the first waste-toner box 60A and the second waste-toner box 60B is mounted selectively on the housing 2.

The second waste-toner box 60B is the waste-toner box 60 that is mounted on the housing 2 of the image forming apparatus 1 with the initial settings at the time of shipment from a factory. That is, the second waste-toner box 60B is initially mounted on the housing 2.

The first waste-toner box 60A is the waste-toner box 60 that is mounted on the housing 2 when the second waste-toner box 60B is replaced and thereafter. That is, when the second waste-toner box 60B is replaced, the first waste-toner box 60A is mounted on the housing 2 as a replacement of the second waste-toner box 60B. When the first waste-toner box 60A mounted on the housing 2 is replaced, a new first waste-toner box 60A is mounted on the housing 2.

The first waste-toner box 60A includes the belt cleaner 40. The first waste-toner box 60A and the belt cleaner 40 are configured integrally as the belt cleaner unit 6. With this configuration, when the first waste-toner box 60A is mounted on the housing 2, it is possible to collect waste toner remaining on the photosensitive drum 54 through the belt 31 during image formation, and store the collected waste toner in the first waste-toner box 60A.

The second waste-toner box 60B includes the belt cleaner 40. The second waste-toner box 60B and the belt cleaner 40 are configured integrally as the belt cleaner unit 6. With this configuration, when with the second waste-toner box 60B is mounted on the housing 2, it is possible to collect waste toner remaining on the photosensitive drum 54 through the belt 31 during image formation, and store the collected waste toner in the second waste-toner box 60B.

Figure 2:
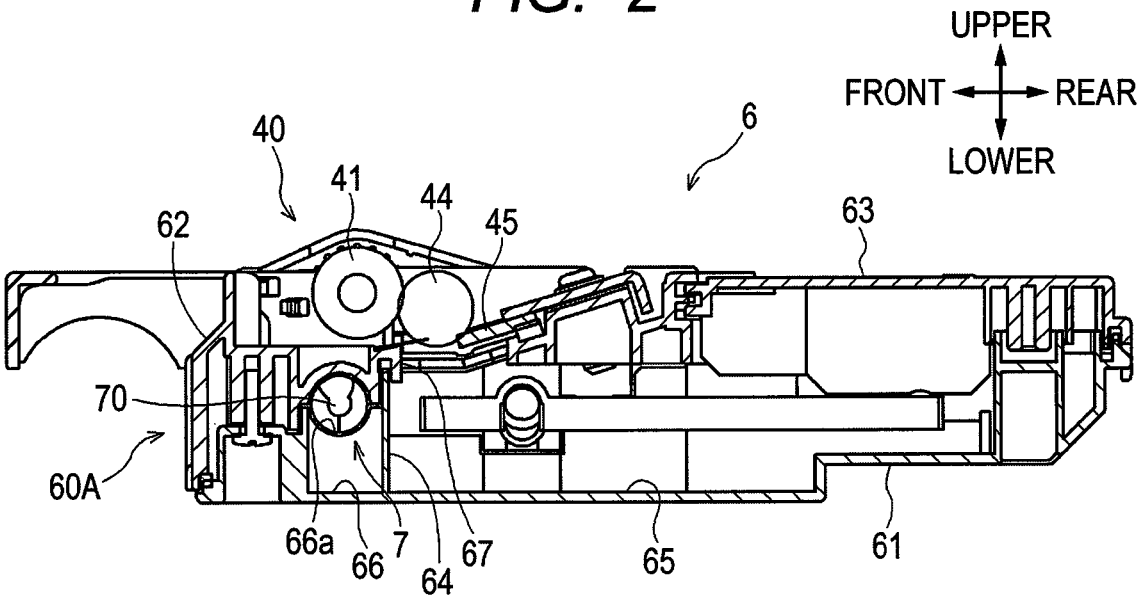
FIG. 2 is a vertical cross-sectional view showing a belt cleaner unit including a first waste-toner box.
Figure 3:
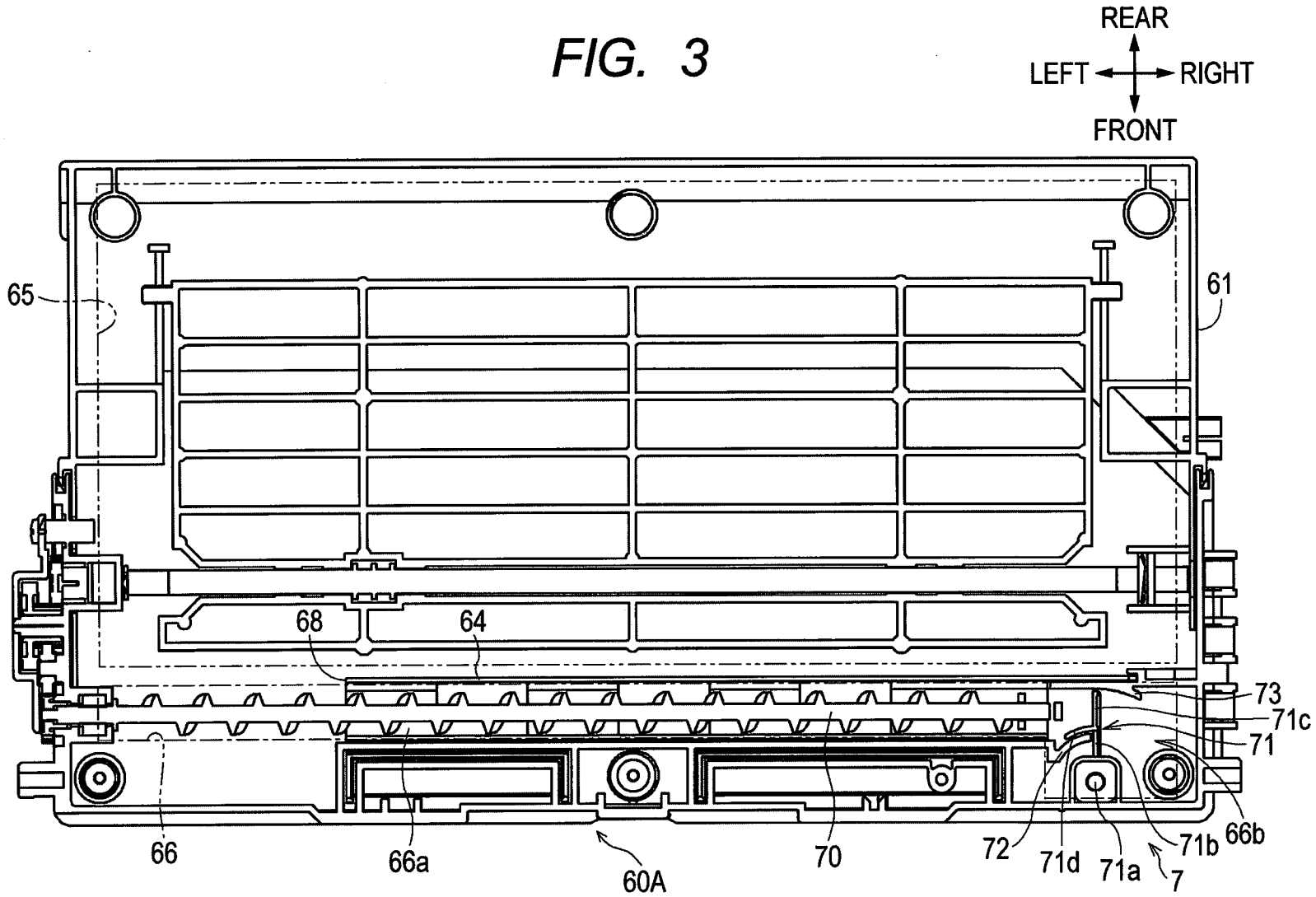
FIG. 3 is a horizontal cross-sectional view showing the belt cleaner unit including the first waste-toner box.

As shown in FIGS. 2 and 3, the first waste-toner box 60A includes a waste-toner detection unit 7 of which the state changes depending on the amount of waste toner stored in the first waste-toner box 60A. The waste-toner detection unit 7 is an example of a detection switch (detection means) of which the state changes depending on the amount of waste toner stored in the first waste-toner box 60A. The second waste-toner box 60B does not include detection means corresponding to the waste-toner detection unit 7 of the first waste-toner box 60A, that is, does not include detection means of which the state changes depending on the amount of stored waste toner.

[Configuration for Detecting Full State of First Waste-Toner Box]

The image forming apparatus 1 is configured to, in a case where the first waste-toner box 60A is mounted on the housing 2, detect the full state of waste toner stored in the first waste-toner box 60A based on the state of the waste-toner detection unit 7. The configuration for detecting the full state of the first waste-toner box 60A will be described next.

As shown in FIGS. 2 and 3, in the first waste-toner box 60A, the partition wall 64 of the housing frame 61 has a communication hole 68 for allowing communication between the first housing portion 65 and the second housing portion 66. The communication hole 68 is arranged at a left end of the partition wall 64. Waste toner stored in the first housing portion 65 is allowed to flow into the second housing portion 66 through the communication hole 68. The second housing portion 66 includes an auger accommodating portion 66*a* and a reservoir portion 66*b*. The reservoir portion 66*b* is arranged at the right side of and adjacent to the auger accommodating portion 66*a*.

The auger accommodating portion 66*a* is formed into a substantially cylindrical shape extending in the left-right direction. An auger screw 70 is rotatably accommodated in the auger accommodating portion 66*a*. The auger screw 70 is formed into a screw shape extending in the left-right direction. The auger screw 70 has an outer diameter substantially equal to the inner diameter of the auger accommodating portion 66*a*. As the auger screw 70 rotates, waste toner having flowed into the second housing portion 66 from the first housing portion 65 is conveyed rightward in the auger accommodating portion 66*a*.

Figure 4:
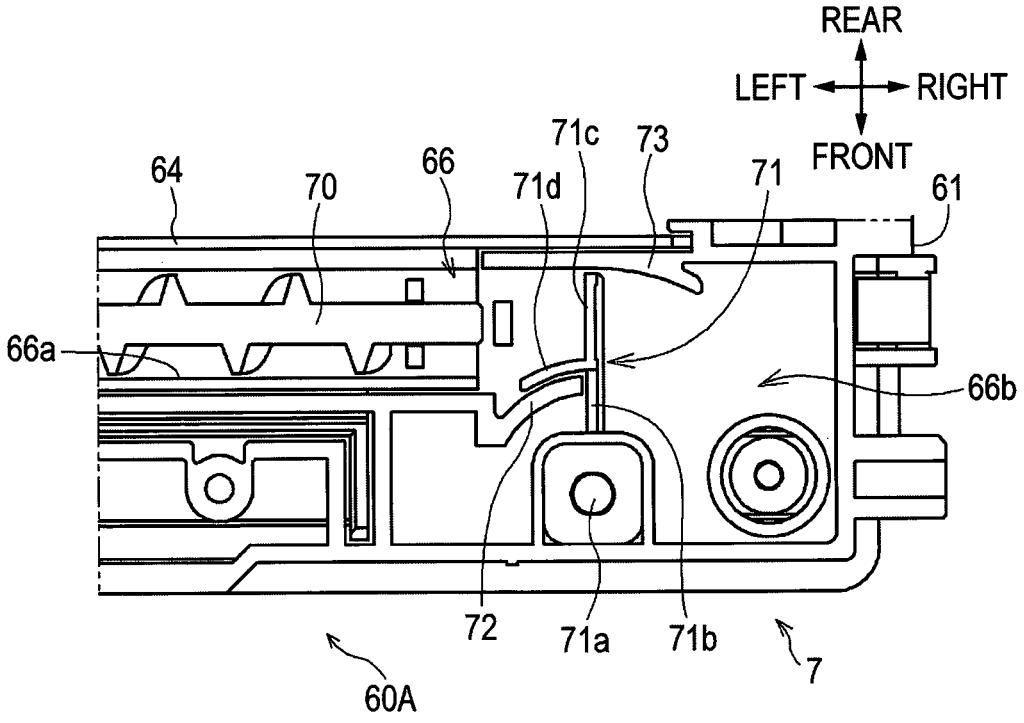
FIG. 4 is a horizontal cross-sectional view showing a storage portion of a second accommodating portion of the first waste-toner box in a state where a flapper is located at a first position.

As shown in FIG. 4, a flapper 71, a first guide plate 72, and a second guide plate 73 are provided in the reservoir portion 66*b*.

In the reservoir portion 66*b*, the flapper 71 is arranged at a position separated rightward from a right end portion of the auger accommodating portion 66*a*. The flapper 71 includes a pivot shaft 71*a*, an extending part 71*b*, a first accumulation part 71*c*, and a second accumulation part 71*d*.

Figure 5:
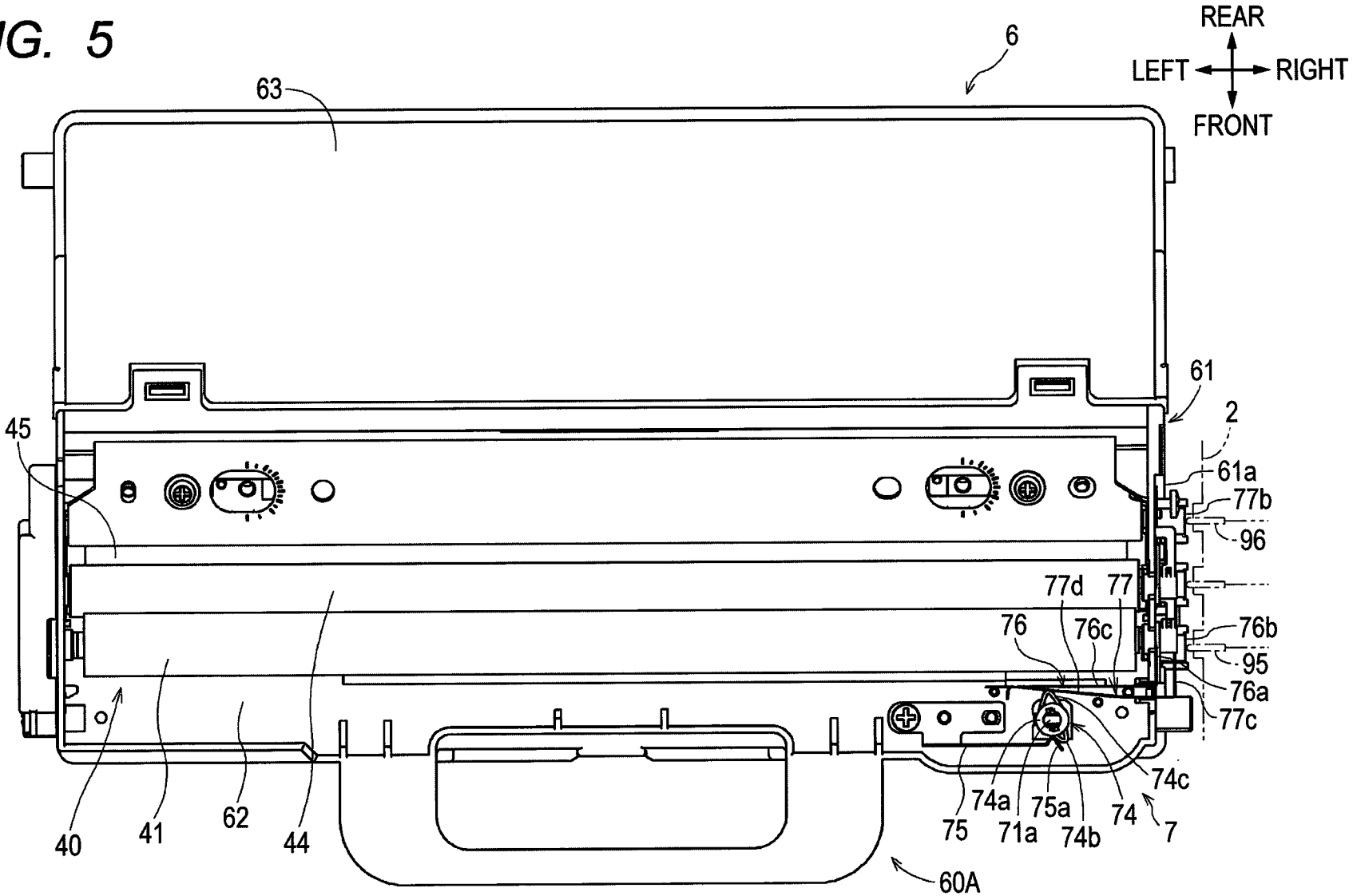
FIG. 5 is a plan view showing the belt cleaner unit including the first waste-toner box in a state where the flapper is located at the first position.

The pivot shaft 71*a* is formed of a substantially circular columnar member extending in the upper-lower direction and is arranged at a front end portion of the reservoir portion 66*b*. The pivot shaft 71*a* has a lower end portion pivotally supported on the bottom surface of the reservoir portion 66*b*. The pivot shaft 71*a* has an upper end portion rotatably supported on the support frame 62. As shown in FIG. 5, the upper end portion of the pivot shaft 71*a* penetrates through the support frame 62 to protrude upward farther than the support frame 62.

The extending part 71*b* is an arm member extending rearward from the pivot shaft 71*a*. The first accumulation part 71*c* is formed of a plate-like member extending rearward from a rear end portion of the extending part 71*b*. The second accumulation part 71*d* is formed of a plate-like member extending leftward from a front end portion of the first accumulation part 71*c*. The second accumulation part 71*d* is formed into a substantially arc-like shape centered on the pivot shaft 71*a* in a plan view.

The first guide plate 72 is a plate-like member extending rightward from the right and front end portion of the auger accommodating portion 66*a*. The first guide plate 72 is formed into a substantially arc-like shape centered on the pivot shaft 71*a* of the flapper 71. The second guide plate 73 is a plate-like member extending rightward from the right and rear end portion of the auger accommodating portion 66*a*. The left half of the second guide plate 73 faces the first guide plate 72 and is formed into a linear shape extending in the left-right direction in a plan view. The right half of the second guide plate 73 is formed into a substantially arc-like shape centered on the pivot shaft 71*a* in a plan view.

Figure 6:
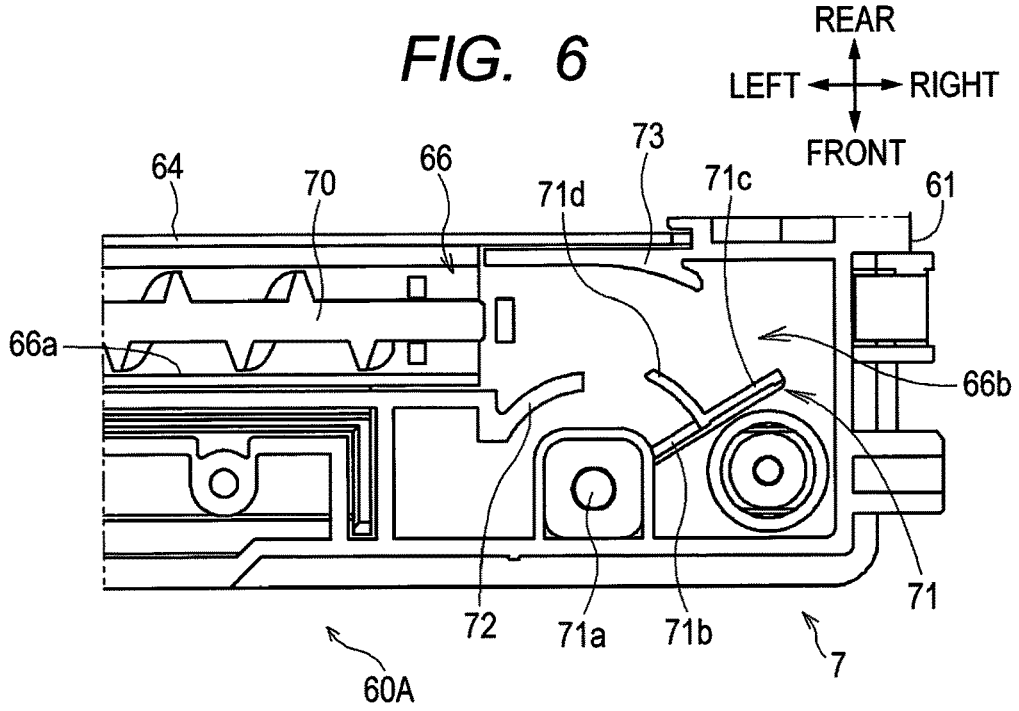
FIG. 6 is a horizontal cross-sectional view showing the storage portion of the second accommodating portion of the first waste-toner box in a state where the flapper is located at a second position.

The flapper 71 is configured to pivotally move about the pivot shaft 71*a*. The pivotal movement of the flapper 71 allows the flapper 71 to shift between a first position (the position shown in FIG. 4) where the extending part 71*b* extends rearward and a second position (the position shown in FIG. 6) where the extending part 71*b* extends rearward and rightward.

When the flapper 71 is located at the first position, the space between the second guide plate 73 and the first guide plate 72 in the front-rear direction is closed by the first accumulation part 71*c* and the second accumulation part 71*d*.

When the flapper 71 is located at the second position, the first accumulation part 71*c* and the second accumulation part 71*d* are separated rightward from the first guide plate 72 and the second guide plate 73 to open the space between the second guide plate 73 and the first guide plate 72 in the front-rear direction.

Figure 7:
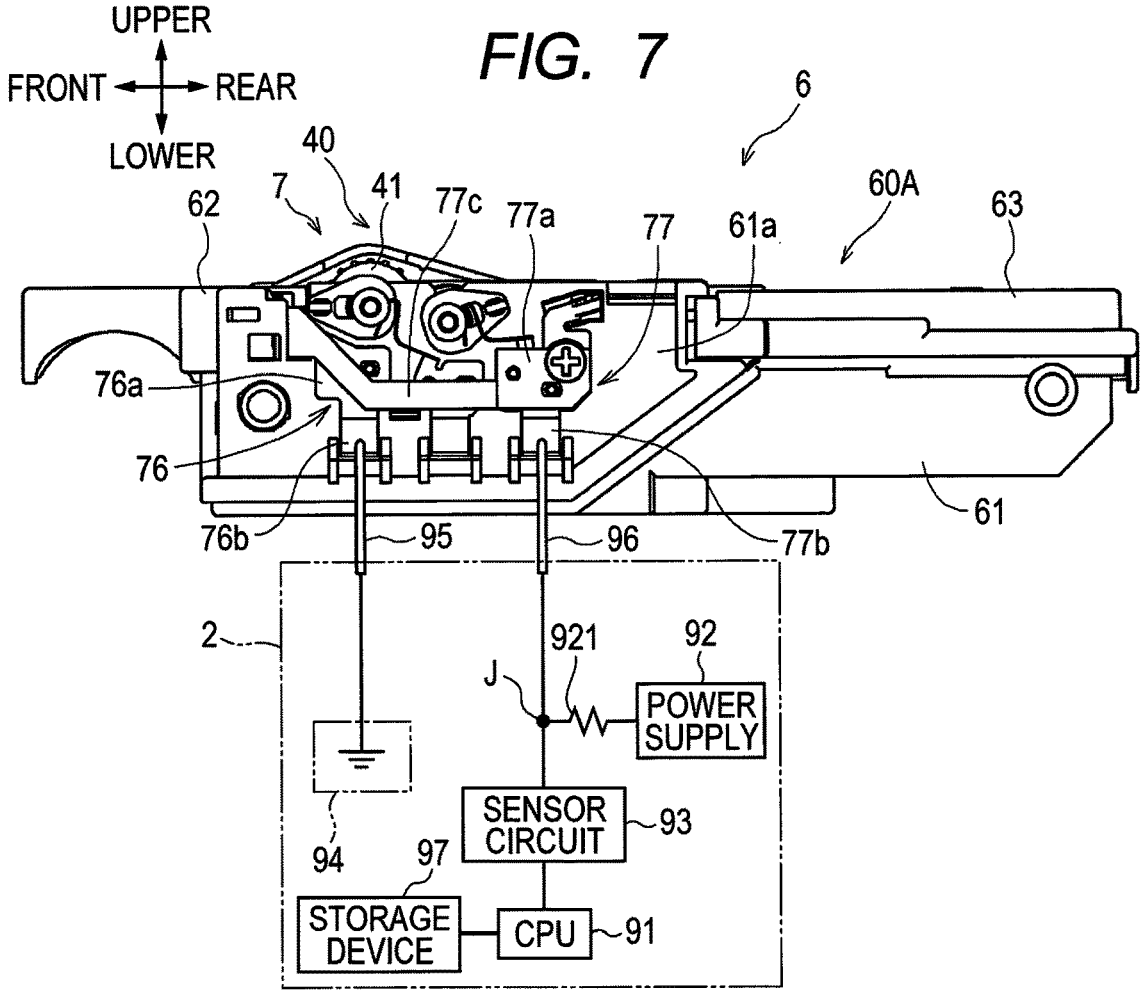
FIG. 7 is a side view showing the belt cleaner unit including the first waste-toner box.

As shown in FIGS. 5 and 7, the first waste-toner box 60A includes a switch cam 74, a leaf spring 75, a first detection electrode 76, and a second detection electrode 77. The switch cam 74 is provided on the upper surface of the support frame 62 and includes a fixed part 74*a*, a biased part 74*b*, and a pressing part 74*c*.

The fixed part 74*a* is supported on the pivot shaft 71*a* of the flapper 71 so as to be pivotally movable integrally with the pivot shaft 71*a*. The biased part 74*b* protrudes forward from the front end of the fixed part 74*a*. The pressing part 74*c* protrudes rearward from the rear end of the fixed part 74*a*. The biased part 74*b* and the pressing part 74*c* are configured to be pivotally (rotatably) movable integrally with the fixed part 74*a*.

The leaf spring 75 is fixed to the upper surface of the support frame 62 at the left side of the switch cam 74. The leaf spring 75 extends in the left-right direction and is formed of a metallic plate of a flat plate shape having a thickness in the front-rear direction. The leaf spring 75 has a left end portion fixed to the support frame 62, and a right end portion where a latching part 75*a* is formed for latching the biased part 74*b* of the switch cam 74.

The first detection electrode 76 is formed of a bent metallic plate and includes a body part 76*a*, an external contact part 76*b*, and a conductive part 76*c*. The body part 76*a* is fixed to a right side surface 61*a* of the housing frame 61. The external contact part 76*b* is formed on the right side surface 61*a* of the housing frame 61 to be downwardly continuous with the body part 76*a*.

The conductive part 76*c* extends leftward from an upper end portion of the body part 76*a* and is arranged on the upper surface of the support frame 62. The conductive part 76*c* is arranged at the rear of the pressing part 74*c* of the switch cam 74. The conductive part 76*c* and the pressing part 74*c* are separated from each other in the front-rear direction.

The second detection electrode 77 is formed of a bent metallic plate and includes a body part 77*a*, an external contact part 77*b*, a first conductive part 77*c*, and a second conductive part 77*d*. The body part 77*a* is arranged at the rear of the body part 76*a* of the first detection electrode 76 and fixed to the right side surface 61*a* of the housing frame 61. The external contact part 77*b* is formed on the right side surface 61*a* of the housing frame 61 to be downwardly continuous with the body part 77*a*.

The first conductive part 77*c* extends forward along the right side surface 61*a* from the body part 77*a*. The second conductive part 77*d* is bent leftward from a front end portion of the first conductive part 77*c* to extend leftward. The second conductive part 77*d* is arranged on the upper surface of the support frame 62. The second conductive part 77*d* is arranged between the pressing part 74*c* of the switch cam 74 and the conductive part 76*c* of the first detection electrode 76 in the front-rear direction. The second conductive part 77*d* is urged forward by the elasticity of the second conductive part 77*d* itself to be separated from the conductive part 76*c*.

In this configuration, when the flapper 71 is located at the first position, the pressing part 74*c* of the switch cam 74 protrudes rearward from the rear end of the fixed part 74*a* to press the second conductive part 77*d* rearward. The second conductive part 77*d* pressed by the pressing part 74*c* is deflected rearward against its elasticity to contact the conductive part 76*c*. That is, when the flapper 71 is located at the first position, the first detection electrode 76 and the second detection electrode 77 are electrically connected.

In this case, the latching part 75*a* of the leaf spring 75 contacts the biased part 74*b* of the switch cam 74 from the left side of the biased part 74*b* to restrict the pivotal movement of the switch cam 74 in the clockwise direction in a plan view.

Figure 8:
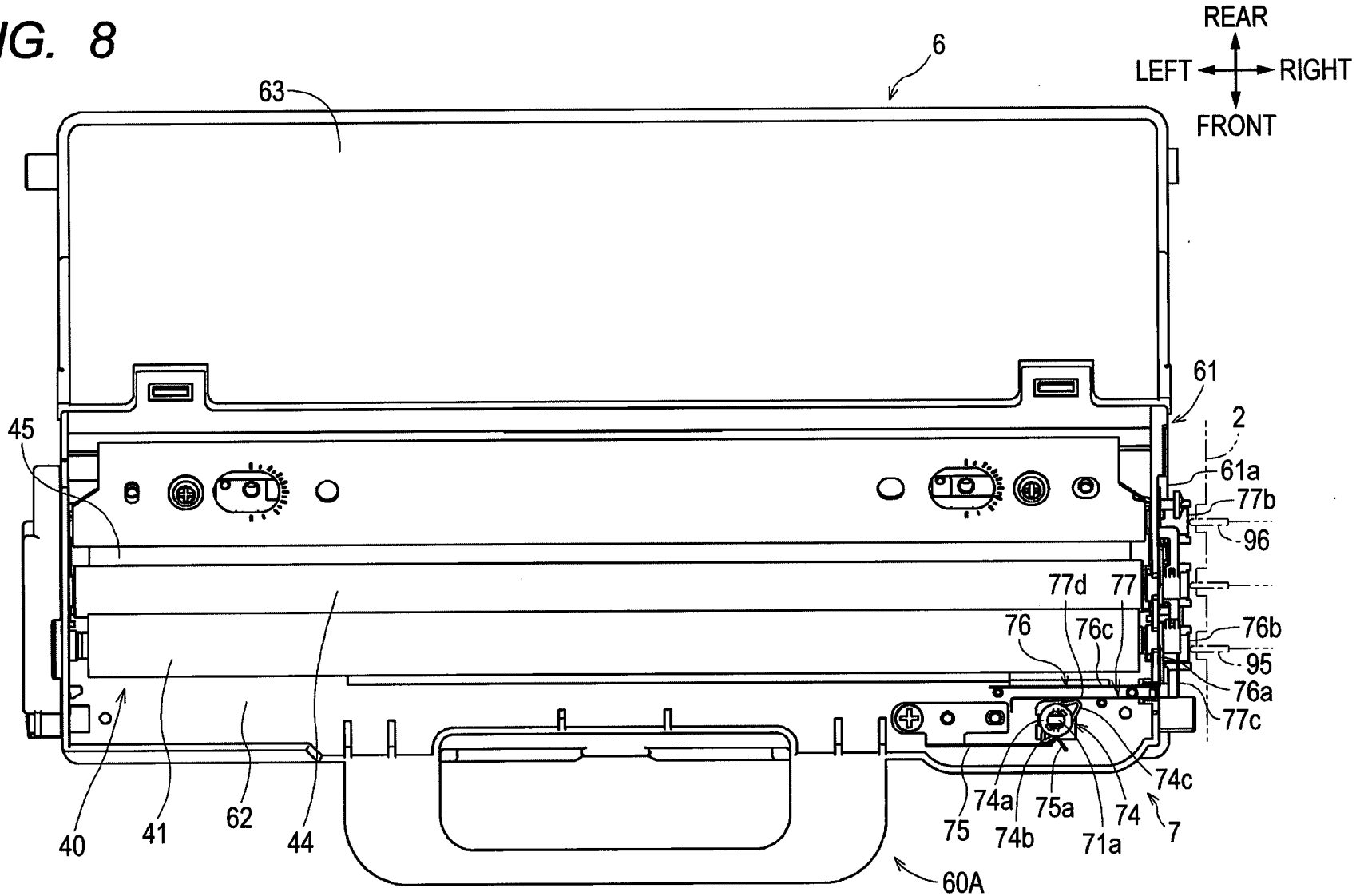
FIG. 8 is a plan view showing the belt cleaner unit including the first waste-toner box in a state where the flapper is located at the second position.

As shown in FIG. 8, when the flapper 71 is located at the second position, the pressing part 74*c* of the switch cam 74 protrudes rightward and rearward from the fixed part 74*a*, and the second conductive part 77*d* is not pressed by the pressing part 74*c*. The second conductive part 77*d* is deflected forward by its elasticity to be separated from the conductive part 76*c*. That is, when the flapper 71 is located at the second position, the first detection electrode 76 and the second detection electrode 77 are not electrically connected.

In this case, the latching part 75*a* of the leaf spring 75 contacts the biased part 74*b* of the switch cam 74 from the right side of the biased part 74*b* to restrict the pivotal movement of the switch cam 74 in the counter-clockwise direction in a plan view.

In the first waste-toner box 60A, the waste-toner detection unit 7 is configured by the auger screw 70, the flapper 71, the switch cam 74, the leaf spring 75, the first detection electrode 76, the second detection electrode 77, and so on.

When the first waste-toner box 60A is not full of waste toner stored therein, the flapper 71 is located at the first position so that the first detection electrode 76 and the second detection electrode 77 are electrically connected. In a state where the first detection electrode 76 and the second detection electrode 77 are electrically connected, the waste-toner detection unit 7 is in a conducting state in which electricity flows between the external contact part 76*b* and the external contact part 77*b*.

When the first waste-toner box 60A is full of waste toner stored therein, the flapper 71 is located at the second position. Thus, the first detection electrode 76 and the second detection electrode 77 are not electrically connected. In a state where the first detection electrode 76 and the second detection electrode 77 are not electrically connected, the waste-toner detection unit 7 is in a non-conducting state in which no electricity flows between the external contact part 76*b* and the external contact part 77*b*.

As described above, the waste-toner detection unit 7 is configured to switch between the conducting state and the non-conducting state depending on the amount of waste toner stored in the first waste-toner box 60A.

As shown in FIG. 7, the housing 2 includes a CPU 91, a power supply 92, a sensor circuit 93, a ground 94, a first connection terminal 95, a second connection terminal 96, and a storage device 97. The sensor circuit 93 is configured to detect the state of the waste-toner detection unit 7 of the first waste-toner box 60A. The CPU 91 is as an example of a controller and control means. The sensor circuit 93 is an example of a sensor circuit and reading means.

The external contact part 76*b* of the first detection electrode 76 is electrically connected to the first connection terminal 95. The first connection terminal 95 is connected to the ground 94 to connect the external contact part 76*b* to the ground.

The external contact part 77*b* of the second detection electrode 77 is electrically connected to the second connection terminal 96. The second connection terminal 96 is connected to the sensor circuit 93. The power supply 92 is connected, through a pull-up resistance 921, to a voltage detection point J between the second connection terminal 96 and the sensor circuit 93, and the voltage detection point J is pulled up by the power supply 92 (a voltage is applied by the power supply 92). In the embodiment, the voltage of the power supply 92 is 3.3 V, for example. The sensor circuit 93 is connected to the CPU 91. The storage device 97 is connected to the CPU 91.

[Operation Relating to Detection of Full State of First Waste-Toner Box]

As shown in FIGS. 4 and 5, when the first waste-toner box 60A is not full of waste toner stored therein, the flapper 71 is located at the first position and the conductive part 76*c* of the first detection electrode 76 and the second conductive part 77*d* of the second detection electrode 77 contact each other to form a conducting state.

Figure 9A:
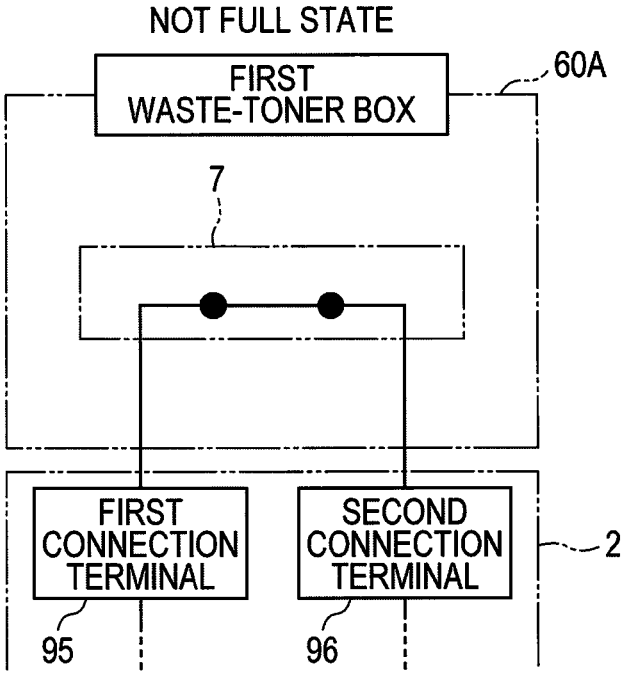
FIG. 9A is an explanatory diagram showing a conducting state of a first connection terminal and a second connection terminal in a state where the first waste-toner box is mounted on a housing and waste toner in the first waste-toner box is not full.

In this case, a circuit is formed from the power supply 92 through the second detection electrode 77 and the first detection electrode 76 to the ground 94 sequentially. Thus, the sensor circuit 93 detects that a potential at the voltage detection point J is a ground potential (=0V). That is, as shown in FIG. 9A, the sensor circuit 93 detects that the first connection terminal 95 and the second connection terminal 96 of the housing 2 are electrically connected and that the waste-toner detection unit 7 is in a conducting state.

As more and more waste toner collected by the belt cleaner 40 is stored into the first housing portion 65 of the first waste-toner box 60A, the waste toner gets stored in a front end portion of the first housing portion 65. When waste toner is further stored in the first waste-toner box 60A after the first housing portion 65 becomes full of the waste toner, the waste toner flows from the first housing portion 65 into the second housing portion 66 through the communication hole 68.

The waste toner having flowed into the second housing portion 66 is conveyed rightward in the auger accommodating portion 66*a* of the second housing portion 66 by the auger screw 70. The waste toner is conveyed into the reservoir portion 66*b* by the auger screw 70. After being conveyed into the reservoir portion 66*b*, the waster toner is accumulated in the space defined by the flapper 71, the first guide plate 72, and the second guide plate 73.

As the amount of the waster toner accumulated in the space increases, the first accumulation part 71*c* of the flapper 71 is pressed rightward by the waste toner. Pressing the flapper 71 rightward causes the flapper 71 and the switch cam 74 to pivot in the clockwise direction in a plan view against the biasing force of the leaf spring 75.

At this time, when the amount of the waste toner accumulated in the space increases so the first waste-toner box 60A becomes full of the waste toner stored therein, the biased part 74*b* of the switch cam 74 gets over the latching part 75*a* of the leaf spring 75 from the right to the left to cause the flapper 71 and the switch cam 74 to pivot in the clockwise direction in a plan view.

When the flapper 71 and the switch cam 74 pivot to place the biased part 74*b* of the switch cam 74 at a position at the left side of the latching part 75*a* of the leaf spring 75, the flapper 71 is shifted to the second position. As shown in FIG. 8, when the flapper 71 is located at the second position, the second conductive part 77*d* of the second detection electrode 77 is separated from the conductive part 76*c* of the first detection electrode 76, and the first detection electrode 76 and the second detection electrode 77 are not electrically connected.

Figure 9B:
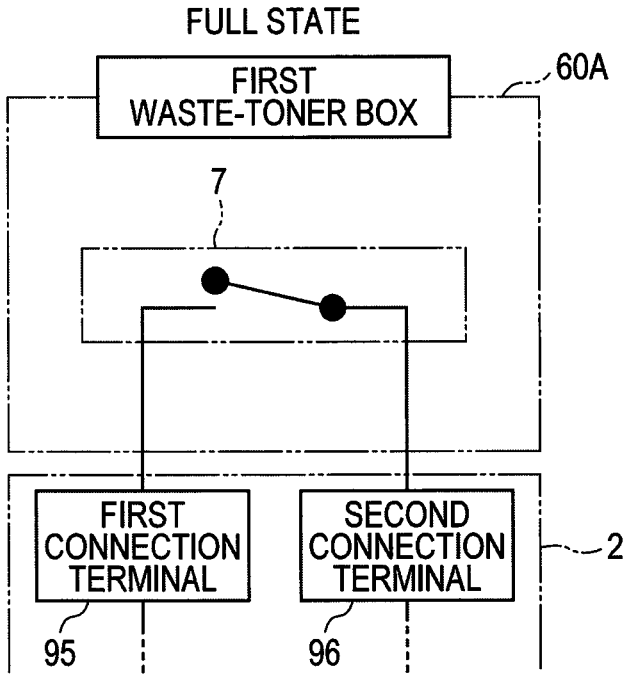
FIG. 9B is an explanatory diagram showing a conducting state of the first connection terminal and the second connection terminal in a state where the first waste-toner box is mounted on the housing and waste toner in the first waste-toner box is full.

In this case, the circuit from the power supply 92 to the ground 94 through the second detection electrode 77 and the first detection electrode 76 is disconnected between the second detection electrode 77 and the first detection electrode 76. Hence, the sensor circuit 93 detects that the potential at the voltage detection point J is the potential of the power supply 92 (=3.3V). That is, as shown in FIG. 9B, the sensor circuit 93 detects that the first connection terminal 95 and the second connection terminal 96 are not electrically connected and that the waste-toner detection unit 7 is in a non-conducting state.

As described above, when the first waste-toner box 60A is not full of waste toner stored therein, the waste-toner detection unit 7 is in a conducting state and the sensor circuit 93 detects that the waste-toner detection unit 7 is in the conducting state. When the first waste-toner box 60A becomes full of the waste toner stored therein, the waste-toner detection unit 7 is switched from the conducting state to a non-conducting state and the sensor circuit 93 detects that the waste-toner detection unit 7 is in the non-conducting state.

[Configuration of Second Waste-Toner Box]

The second waste-toner box 60B does not include the auger screw 70, the flapper 71, the switch cam 74, the leaf spring 75, the first detection electrode 76, and the second detection electrode 77 constituting the waste-toner detection unit 7 of the first waste-toner box 60A. That is, the second waste-toner box 60B does not include detection means of which the state changes depending on the amount of waste toner stored therein.

Thus, when the second waste-toner box 60B is mounted on the housing 2, the first connection terminal 95 and the second connection terminal 96 of the housing 2 are not connected to the external contact part 76*b* of the first detection electrode 76 and the external contact part 77*b* of the second detection electrode 77, respectively. Thus, the first connection terminal 95 and the second connection terminal 96 are not electrically connected regardless of the amount of waste toner stored in the second waste-toner box 60B.

Figure 10A:
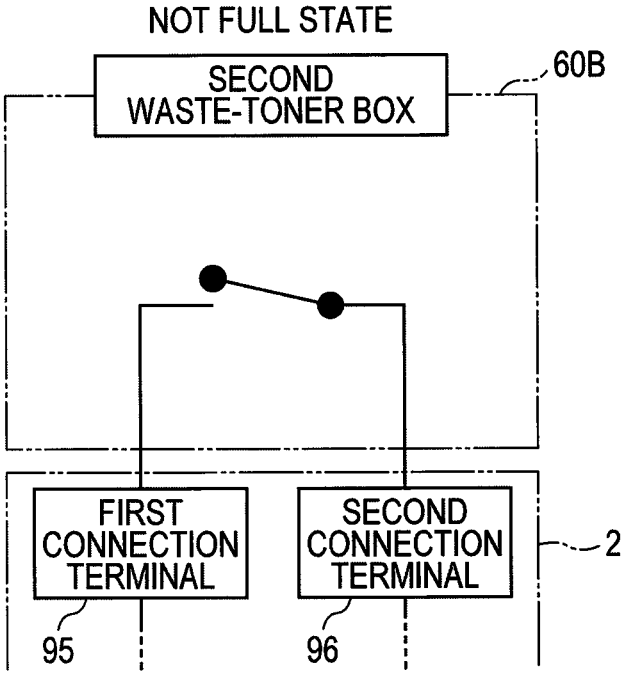
FIG. 10A is an explanatory diagram showing a conducting state of the first connection terminal and the second connection terminal in a state where a second waste-toner box is mounted on the housing and waste toner in the second waste-toner box is not full.

That is, as shown in FIG. 10A, when the second waste-toner box 60B is in a state of shipment and is not full of waste toner, the first connection terminal 95 and the second connection terminal 96 are not electrically connected. In this case, the sensor circuit 93 detects that the first connection terminal 95 and the second connection terminal 96 are not electrically connected.

Figure 10B:
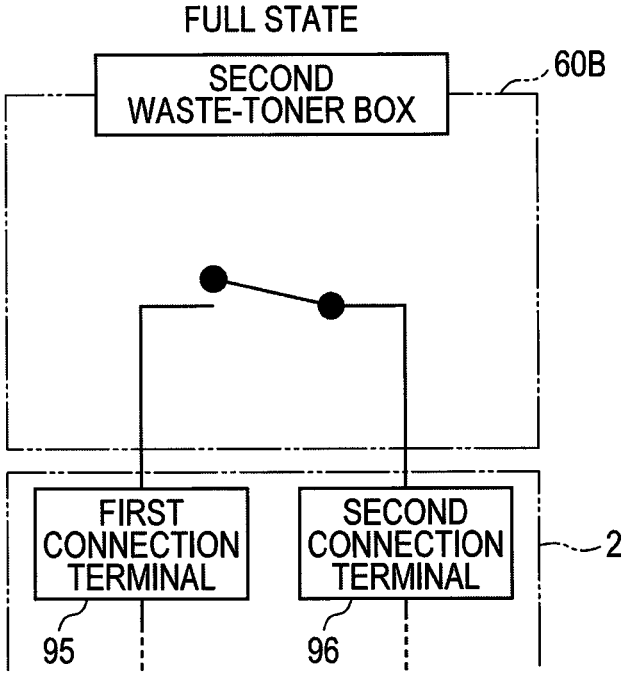
FIG. 10B is an explanatory diagram showing a conducting state of the first connection terminal and the second connection terminal in a state where the second waste-toner box is mounted on the housing and waste toner in the second waste-toner box is full.

As shown in FIG. 10B, when the second waste-toner box 60B becomes full of waste toner, the first connection terminal 95 and the second connection terminal 96 remain not electrically connected. In this case, the sensor circuit 93 detects that the first connection terminal 95 and the second connection terminal 96 are not electrically connected.

As described above, when the second waste-toner box 60B is mounted on the housing 2, the sensor circuit 93 detects that the first connection terminal 95 and the second connection terminal 96 are not electrically connected regardless of the amount of waste toner stored in the second waste-toner box 60B.

As long as the second waste-toner box 60B is configured such that the first connection terminal 95 and the second connection terminal 96 are not electrically connected regardless of the amount of waste toner stored therein, the second waste-toner box 60B may include some of the auger screw 70, the flapper 71, the switch cam 74, the leaf spring 75, the first detection electrode 76, and the second detection electrode 77 constituting the waste-toner detection unit 7.

The second waste-toner box 60B has the same configuration as the first waste-toner box 60A except that the second waste-toner box 60B has no detection means corresponding to the waste-toner detection unit 7 of the first waste-toner box 60A. The configuration of the second waste-toner box 60B which is the same as that of the first waste-toner box 60A will not be described.

[Control for Detecting Full State of Waste-Toner Box]

In the image forming apparatus 1 having the foregoing configuration, in response to the input of a job of forming an image on the sheet S, the CPU 91 executes a full-state detection control for detecting the full state of the waste-toner box 60.

Figure 11:
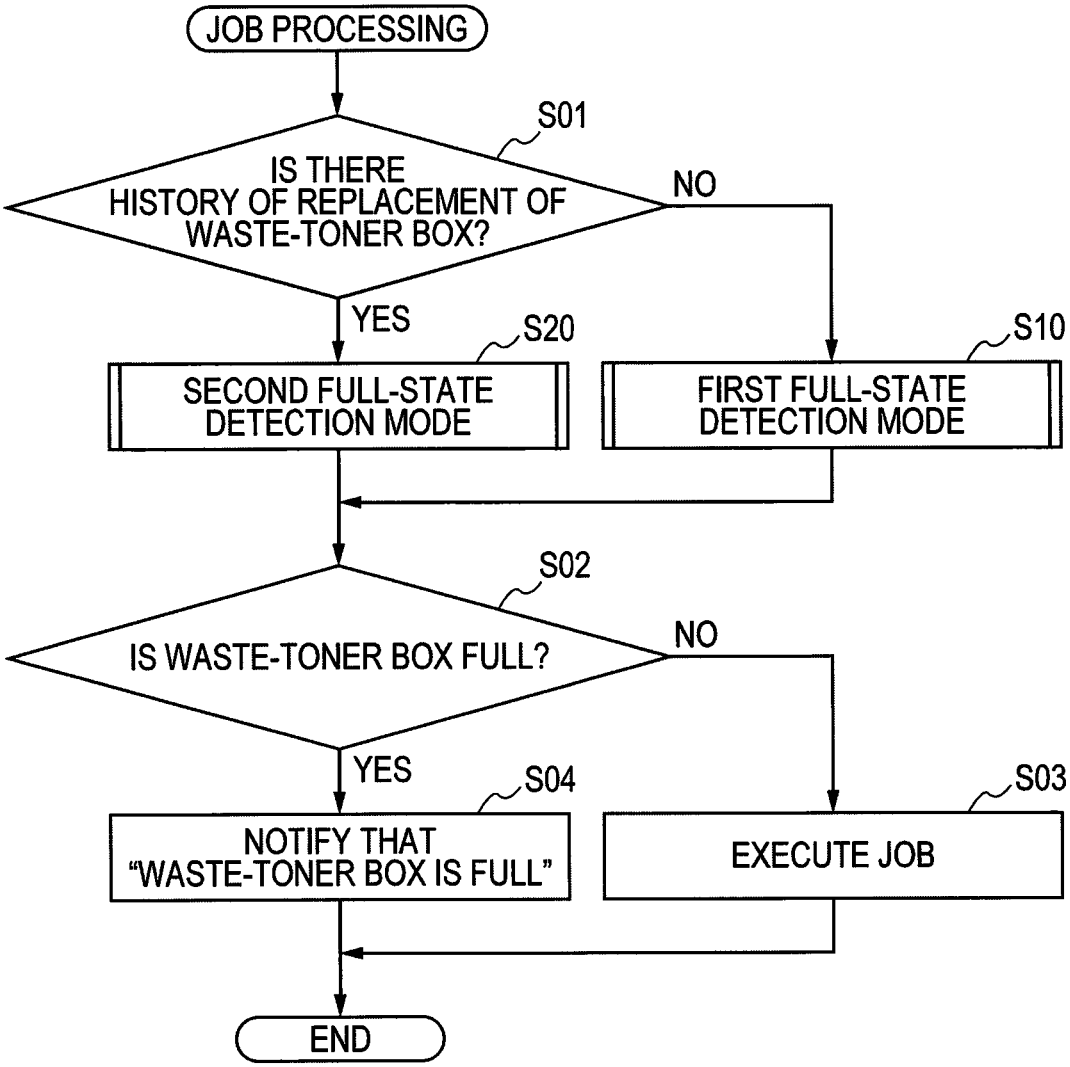
FIG. 11 is a flowchart showing a full-state detection control of a waste-toner box.

As shown in FIG. 11, in the full-state detection control, when job processing is started, the CPU 91 determines whether there is a history of replacement of the waste-toner box 60 (S01).

In a case where the sensor circuit 93 continuously detects that the first connection terminal 95 and the second connection terminal 96 are not electrically connected since the power of the image forming apparatus 1 is turned on for the first time, the CPU 91 determines that there is no history of replacement of the waste-toner box 60. When the sensor circuit 93 initially detects that the waste-toner detection unit 7 is in a conducting state, the CPU 91 determines that there is a history of replacement of the waste-toner box 60.

The second waste-toner box 60B is mounted on the image forming apparatus 1 having the initial settings at the time of shipment from a factory. In a state where the second waste-toner box 60B is mounted, the sensor circuit 93 detects that the first connection terminal 95 and the second connection terminal 96 are not electrically connected regardless of the amount of waste toner stored in the second waste-toner box 60B.

In a state where the second waste-toner box 60B has been replaced and a new first waste-toner box 60A is mounted on the image forming apparatus 1, the new first waste-toner box 60A is not full, and thus the sensor circuit 93 detects that the waste-toner detection unit 7 is in a conducting state.

Thus, in a case where the sensor circuit 93 continuously detects that the first connection terminal 95 and the second connection terminal 96 are not electrically connected since the shipment of the image forming apparatus 1 from the factory, the CPU 91 determines that there is no history of replacement of the waste-toner box 60.

When the second waste-toner box 60B is replaced with the first waste-toner box 60A, the sensor circuit 93 detects that the waste-toner detection unit 7 is in a conducting state. Thus, when the sensor circuit 93 initially detects that the waste-toner detection unit 7 is in a conducting state, the CPU 91 determines that there is a history of replacement of the waste-toner box 60.

In response to determining in S01 that there is no history of replacement of the waste-toner box 60 (S01: No), the CPU 91 executes a first full-state detection mode S10. That is, in the image forming apparatus 1 with the initial settings, the CPU 91 executes the control for detecting the full state of the waste-toner box 60 in the first full-state detection mode S10.

In a state where there is no history of replacement of the waste-toner box 60 and the second waste-toner box 60B is mounted on the image forming apparatus 1, the sensor circuit 93 detects that the first connection terminal 95 and the second connection terminal 96 are not electrically connected regardless of whether the second waste-toner box 60B is full.

Thus, in the first full-state detection mode S10, the CPU 91 detects the full state of the second waste-toner box 60B based on a dot count showing the number of dots forming a toner image formed on the sheet S, without using the results of a detection by the sensor circuit 93.

Figure 12:
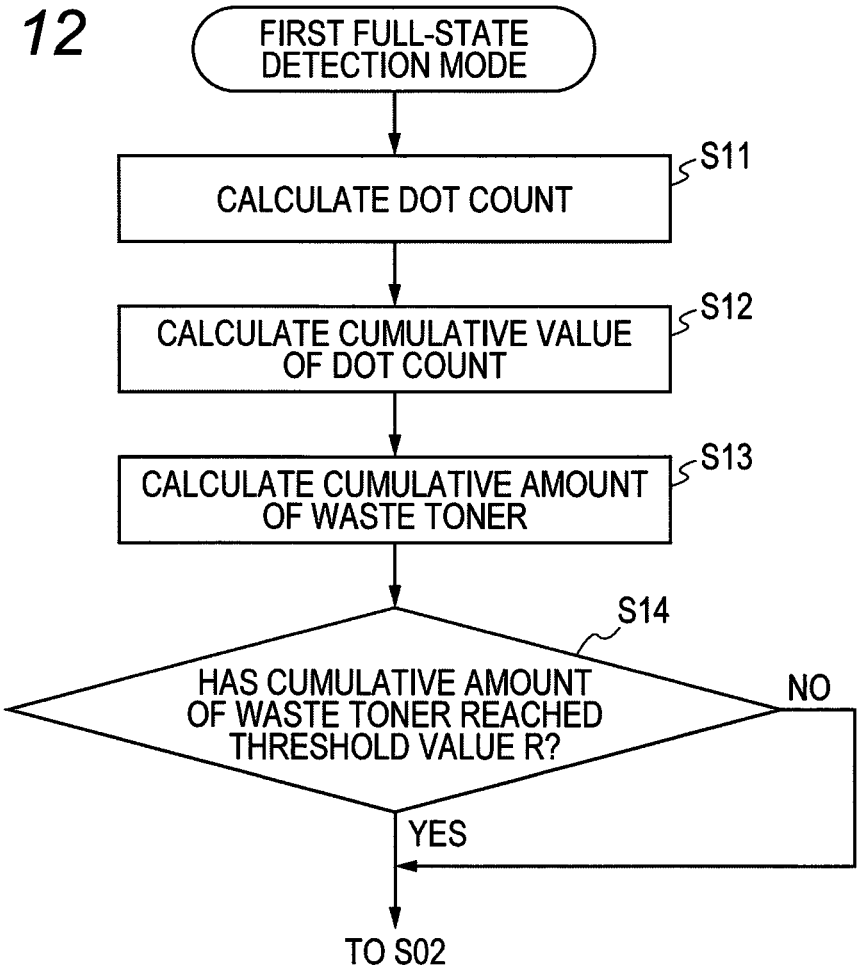
FIG. 12 is a flowchart showing a first full-state detection mode.

As shown in FIG. 12, in the first full-state detection mode S10, the CPU 91 calculates a dot count showing the number of dots forming a toner image formed on the sheet S based on image formation data contained in the input job (S11). If images are to be formed on a plurality of sheets S, the CPU 91 calculates dot counts of each of the corresponding sheets S and adds the dot counts of each of the corresponding sheets S, thereby calculating a cumulative value of dot count (S12).

Based on the calculated cumulative value of dot count, the CPU 91 calculates a cumulative amount of waste toner showing the amount of waste toner to be generated by forming images on the plurality of sheets S (S13). The storage device 97 stores a relationship between a dot count value and the amount of waste toner to be generated by transferring a toner image onto the sheet S. The CPU 91 calculates the cumulative amount of waste toner by using this relationship and the cumulative value of dot count.

If an image is formed on one sheet S based on the inputted job, the cumulative amount of waste toner is calculated based on the dot count for one sheet S.

The storage device 97 preliminarily stores a threshold value R for the cumulative amount of waste toner in order to determine whether the first waste-toner box 60A is full. The CPU 91 determines whether the calculated cumulative amount of waste toner has reached the threshold value R (S14).

In response to determining in S14 that the cumulative amount of waste toner has not reached the threshold value R (S14: No), the CPU 91 proceeds to S02 and determines that the first waste-toner box 60A is not full (S02: No). In response to determining in S02 that the first waste-toner box 60A is not full, the CPU 91 executes the job (S03) to form an image on the sheet S.

In response to determining in S14 that the cumulative amount of waste toner has reached the threshold value R (S14: Yes), the CPU 91 proceeds to S02 and determines that the first waste-toner box 60A is full (S02: Yes). In response to determining in S02 that the first waste-toner box 60A is full, the CPU 91 outputs a notification that "the waste-toner box is full" by using a notification device of the image forming apparatus (S04).

In response to determining in S01 that there is a history of replacement of the waste-toner box 60 (S01: Yes), the CPU 91 executes a second full-state detection mode S20. That is, when the sensor circuit 93 initially detects that the waste-toner detection unit 7 is in a conducting state, the CPU 91 shifts from the first full-state detection mode S10 to the second full-state detection mode S20.

In response to determining that there is a history of replacement of the waste-toner box 60, the CPU 91 stores information indicating that there is a history of replacement in the storage device 97. With this operation, in a case where the first waste-toner box 60A is replaced and a new first waste-toner box 60A is mounted, the CPU 91 executes the second full-state detection mode S20 based on the information indicating that there is a history of replacement which is stored in the storage device 97.

In a state where there is a history of replacement of the waste-toner box 60 and the first waste-toner box 60A is mounted on the image forming apparatus 1, the sensor circuit 93 detects that the waste-toner detection unit 7 is in a conducting state when the first waste-toner box 60A is not full. When the first waste-toner box 60A becomes full, the sensor circuit 93 detects that the waste-toner detection unit 7 is in a non-conducting state.

As described above, in the second full-state detection mode S20, the CPU 91 detects the full state of the first waste-toner box 60A based on whether the state of the waste-toner detection unit 7 detected by the sensor circuit 93 is a conducting state or a non-conducting state.

Figure 13:
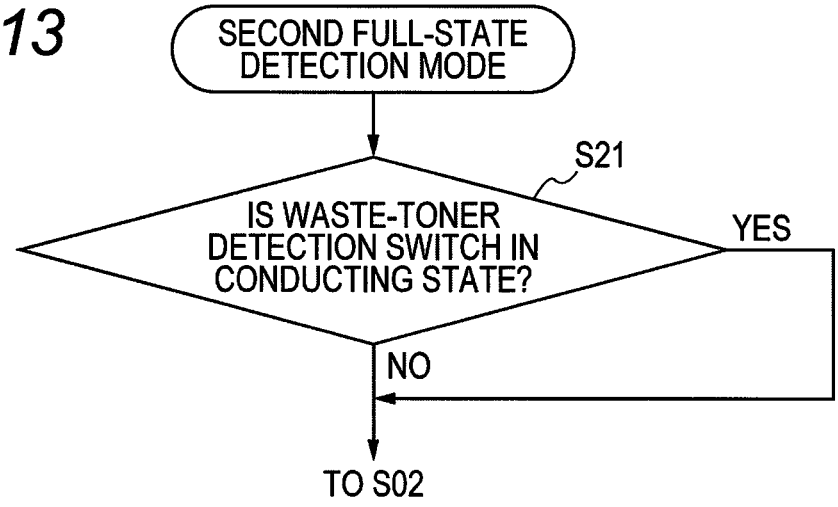
FIG. 13 is a flowchart showing a second full-state detection mode.

As shown in FIG. 13, in the second full-state detection mode S20, the CPU 91 determines whether the sensor circuit 93 has detected that the waste-toner detection unit 7 is in a conducting state (S21).

In response to determining in S21 that the sensor circuit 93 has detected that the waste-toner detection unit 7 is in a conducting state (S21: Yes), the CPU 91 proceeds to S02 and determines that the first waste-toner box 60A is not full (S02: No). In response to determining in S02 that the first waste-toner box 60A is not full, the CPU 91 executes the job (S03) to form an image on the sheet S.

In response to determining in S21 that the sensor circuit 93 has determined that the waste-toner detection unit 7 is in a non-conducting state (S21: No), the CPU 91 proceeds to S02 and determines that the first waste-toner box 60A is full (S02: Yes). In response to determining in S02 that the first waste-toner box 60A is full, the CPU 91 outputs a notification that "the waste-toner box is full" by using the notification device of the image forming apparatus 1 (S04).

According to the foregoing control for detecting the full state of the waste-toner box 60, in the image forming apparatus 1 with the initial settings on which the second waste-toner box 60B is mounted, the full state of the second waste-toner box 60B is detected based on a dot count. This eliminates the need of providing the second waste-toner box 60B with detection means corresponding to the waste-toner detection unit 7, which reduces the costs of the second waste-toner box 60B. This suppresses wastefulness for a user who mainly forms images generating small amounts of waste toner.

After the second waste-toner box 60B is replaced with the first waste-toner box 60A, the full state of the first waste-toner box 60A is detected based on the state of the waste-toner detection unit 7 provided at the first waste-toner box 60A. This reduces labor and costs of replacing the waste-toner box for a user who forms images generating large amounts of waste toner.

According to the control for detecting the full state of the waste-toner box 60, when the sensor circuit 93 initially detects that the waste-toner detection unit 7 is in a conducting state, the CPU 91 shifts from the first full-state detection mode S10 to the second full-state detection mode S20. With this configuration, the first full-state detection mode S10 is switched to the second full-state detection mode S20 only by making a switch of control by the CPU 91. Thus, switching between the modes can be performed easily.

According to the control for detecting the full state of the waste-toner box 60, the waste-toner detection unit 7 is configured to be located at a conducting state when the first waste-toner box 60A is not full of waste toner stored therein, and be located at a non-conducting state when the first waste-toner box 60A is full of the waste toner stored therein. The CPU 91 detects the full state of the first waste-toner box 60A based on the state of the waste-toner detection unit 7 detected by the sensor circuit 93.

By detecting the full state of the first waste-toner box 60A based on the state of the waste-toner detection unit 7 in this way, the full state of the first waste-toner box 60A can be detected easily.

While the disclosure has been described in detail with reference to the above aspects thereof, it would be apparent to those skilled in the art that various changes and modifications may be made therein without departing from the scope of the claims.

What is claimed is:

1. An image forming apparatus comprising:

a photosensitive drum;

a belt disposed to face the photosensitive drum;

a housing configured such that one of a first waste-toner box and a second waste-toner box is selectively mounted thereon, the first waste-toner box including a detection switch wherein a state of the detection switch changes depending on an amount of waste toner stored therein, the second waste-toner box not including the detection switch, the second waste-toner box being initially mounted on the housing, the first waste-toner box being mounted on the housing after replacement of the second waste-toner box;

a sensor circuit configured to detect the state of the detection switch; and a controller configured to:

in a case where the second waste-toner box is mounted on the housing, perform a first full-state detection mode of detecting a full state of waste toner stored in the second waste-toner box based on a dot count that is a number of dots forming a toner image formed on a sheet; and in a case where the first waste-toner box is mounted on the housing, perform a second full-state detection mode of detecting a full state of waste toner stored in the first waste-toner box based on the state of the detection switch detected by the sensor circuit.

2. The image forming apparatus according to claim 1, wherein the detection switch is configured to be switched between a conducting state and a non-conducting state based on an amount of waste toner stored in the first waste-toner box; and wherein the controller is configured to, in response to detecting for a first time by the sensor circuit that the detection switch is in the conducting state, shift from the first full-state detection mode to the second full-state detection mode.

3. The image forming apparatus according to claim 1, wherein the detection switch is configured to:

be in a conducting state in a case where the waste toner stored in the first waste-toner box is not the full state; and be in a non-conducting state in a case where the waste toner stored in the first waste-toner box is the full state; and wherein the controller is configured to detect the full state of the waste toner stored in the first waste-toner box based on the state of the detection switch detected by the sensor circuit.

4. The image forming apparatus according to claim 1, wherein the first waste-toner box includes a belt cleaner configured to collect waste toner from the belt.

5. The image forming apparatus according to claim 1, wherein the second waste-toner box includes a belt cleaner configured to collect waste toner from the belt.

6. The image forming apparatus according to claim 1, wherein, in a case where the second waste-toner box is mounted on the housing, the sensor circuit detects a non-conducting state of the detection switch regardless of an amount of waste toner stored in the second waste-toner box; and wherein, in a case where the first waste-toner box is mounted on the housing, the sensor circuit detects:

a conducting state of the detection switch when the waste toner stored in the first waste-toner box is not the full state; and a non-conducting state of the detection switch when the waste toner stored in the first waste-toner box is the full state.

7. The image forming apparatus according to claim 1, further comprising:

a first connection terminal connected to ground;

a second connection terminal connected to a power supply;

wherein the first waste-toner box includes a first detection electrode and a second detection electrode;

wherein, in a state where the first waste-toner box is mounted on the housing, the first connection terminal is connected to the first detection electrode and the second connection terminal is connected to the second detection electrode;

wherein, when the waste toner stored in the first waste-toner box is not the full state in a state where the first waste-toner box is mounted on the housing, the first detection electrode and the second detection electrode are connected and thus the first connection terminal and the second connection terminal are connected;

wherein, when the waste toner stored in the first waste-toner box is the full state in a state where the first waste-toner box is mounted on the housing, the first detection electrode and the second detection electrode are disconnected and thus the first connection terminal and the second connection terminal are disconnected; and wherein, in a state where the second waste-toner box is mounted on the housing, the first connection terminal and the second connection terminal are disconnected regardless of whether the waste toner stored in the second waste-toner box is the full state or not the full state.

8. An image forming apparatus comprising:

a photosensitive drum;

a belt disposed to face the photosensitive drum;

a housing configured such that one of a first waste-toner box and a second waste-toner box is selectively mounted thereon, the first waste-toner box including detection means wherein a state of the detection means changes depending on an amount of waste toner stored therein, the second waste-toner box not including the detection means, the second waste-toner box being initially mounted on the housing, the first waste-toner box being mounted on the housing after replacement of the second waste-toner box;

reading means for reading the state of the detection means; and control means for:

in a case where the second waste-toner box is mounted on the housing, performing a first full-state detection mode of detecting a full state of waste toner stored in the second waste-toner box based on a dot count that is a number of dots forming a toner image formed on a sheet; and in a case where the first waste-toner box is mounted on the housing, performing a second full-state detection mode of detecting a full state of waste toner stored in the first waste-toner box based on the state of the detection means read by the reading means.

9. The image forming apparatus according to claim 8, wherein the detection means is configured to be switched between a conducting state and a non-conducting state based on an amount of waste toner stored in the first waste-toner box; and wherein the control means is configured to, in response to reading for a first time by the reading means that the detection means is in the conducting state, shift from the first full-state detection mode to the second full-state detection mode.

10. The image forming apparatus according to claim 8, wherein the detection means is configured to:

be in a conducting state in a case where the waste toner stored in the first waste-toner box is not the full state; and be in a non-conducting state in a case where the waste toner stored in the first waste-toner box is the full state; and wherein the control means is configured to detect the full state of the waste toner stored in the first waste-toner box based on the state of the detection means read by the reading means.

11. The image forming apparatus according to claim 8, wherein the first waste-toner box includes a belt cleaner configured to collect waste toner from the belt.

12. The image forming apparatus according to claim 8, wherein the second waste-toner box includes a belt cleaner configured to collect waste toner from the belt.

13. The image forming apparatus according to claim 8, wherein, in a case where the second waste-toner box is mounted on the housing, the reading means reads a non-conducting state of the detection means regardless of an amount of waste toner stored in the second waste-toner box; and wherein, in a case where the first waste-toner box is mounted on the housing, the reading means reads:

a conducting state of the detection means when the waste toner stored in the first waste-toner box is not the full state; and a non-conducting state of the detection means when the waste toner stored in the first waste-toner box is the full state.

14. The image forming apparatus according to claim 8, further comprising:

a first connection terminal connected to ground;

a second connection terminal connected to a power supply;

wherein the first waste-toner box includes a first detection electrode and a second detection electrode;

wherein, in a state where the first waste-toner box is mounted on the housing, the first connection terminal is connected to the first detection electrode and the second connection terminal is connected to the second detection electrode;

wherein, when the waste toner stored in the first waste-toner box is not the full state in a state where the first waste-toner box is mounted on the housing, the first detection electrode and the second detection electrode are connected and thus the first connection terminal and the second connection terminal are connected;

wherein, when the waste toner stored in the first waste-toner box is the full state in a state where the first waste-toner box is mounted on the housing, the first detection electrode and the second detection electrode are disconnected and thus the first connection terminal and the second connection terminal are disconnected; and wherein, in a state where the second waste-toner box is mounted on the housing, the first connection terminal and the second connection terminal are disconnected regardless of whether the waste toner stored in the second waste-toner box is the full state or not the full state.

* * * * *